United States Patent [19]

Cooke

[11] Patent Number: 5,050,542

[45] Date of Patent: Sep. 24, 1991

[54] BOILER

[75] Inventor: George Cooke, Arvada, Colo.

[73] Assignee: Volcano Energy Systems, Inc., St.-Hyacinthe, Canada

[21] Appl. No.: 634,584

[22] Filed: Dec. 27, 1990

[51] Int. Cl.[5] ..... F22B 15/00; F22B 25/00

[52] U.S. Cl. ..... 122/235.23; 122/6 A; 122/235.15

[58] Field of Search ..... 122/235.11, 6 A, 235.15, 122/235.23, 136 R, 142

[56] References Cited

U.S. PATENT DOCUMENTS 1,304,499 5/1919 Meier ..... 122/235.19

4,357,907 11/1982 Campbell, Jr. et al. ... 122/235.12 X

*Primary Examiner*—Edward G. Favors

*Attorney, Agent, or Firm*—Longacre & White

[57] ABSTRACT

A highly efficient boiler is made up of a housing containing upper and lower left and right water manifolds. Tubes connect the left manifolds and other tubes the right manifolds. The tubes are bent toward one another to form a plurality of superposed chambers through which combustion gases must successively flow, from front to back in one chamber and from back to front within the next. Baffles may be provided in each chamber to cause the gas to traverse a sinuous path from left to right and right to left within each chamber. Adjustment of the baffles can be effected during operation to keep the combustion gas exit pressure or temperature or flow rate constant notwithstanding changes in the liquid flow rate through the tubes or the rate of combustion of fuel in the lowermost chamber.

10 Claims, 18 Drawing Sheets

BOILER

FIELD OF THE INVENTION

The present invention relates to a novel construction of a boiler, or similar heat exchangers, for heating water while cooling hot gases which are the products of combustion.

BACKGROUND OF THE INVENTION

Numerous designs exist in connection with this type of boilers: see, for example, U.S. Pat. No. 4,355,602 issued Oct. 26, 1982 to Cooke as well as U.S. patent application Ser. No. 536,836 filed June 12, 1990 U.S. Pat. No. 4,993,368. However, these constructions, which mainly consist of upper and lower manifolds between which a plurality of serpentine liquid carrying tubes are mounted, do not permit the heated liquid, entering at diametrically opposite ports on the upper manifold, to be at substantially the same temperature and to have substantially the same liquid flow.

OBJECTS AND STATEMENT OF THE INVENTION

It is an object of the present invention to provide a boiler which is simple to construct, to assemble and to operate, which is highly efficient and capable of handling varying loads, and which is suitable for use on a large scale, as in large buildings, industrial electric and co-generation plants as well as in relatively small residential installations.

These objects are achieved by providing a boiler in accordance with the present invention which comprises a housing having a top provided with a gas outlet, which can be positioned either at the front or the rear of the housing to suit individual site conditions, a bottom, left and right sides, and a front and back. Within the housing, an upper manifold and lower manifold extend substantially parallel to the top, bottom and side walls; between these two manifolds, two sets of tubes are displayed. Each set of tubes is identical, the tubes being bent serpentinely so as to form a plurality of superimposed gas passages; at least two tubes of each set are bent differently so as to form access openings to the passages above and below.

The bends of the serpentine tubes are substantially in contact so they close the lowermost chamber and the gas passages at the center of the housing. The gas passages are closed on the sides by removable closing plates. One set of tubes joins the upper left side of the upper manifold to the lower left side of the lower manifold while the other set of tubes joins the upper right side of the upper manifold to the lower right of the lower manifold. The openings from passage to passage are offset so as to require a gas flowing through said passages to traverse one passage from front to back and the next passage from back to front. Means are provided for introducing liquid into the lower manifold and for withdrawing the liquid from the upper manifold; means are also provided for introducing a combustion gas into the lowermost of the superimposed passages. The combustion gases rise successively through the passages which it successively and alternately traverses from front to back and, then, from back to front, until it exits from the uppermost chamber through the gas outlet at the top, liquid flowing through the manifolds and tubes being heated by the combustion gases.

Advantageously, the tubes of each set are in substantial contact with one another so as to substantially prevent passage of combustion gas therebetween. In a preferred embodiment, there is provided at least one damper at at least one of the access openings so the furnace pressure can be controlled in conjunction with the amount of products of combustion being produced.

It is an object of the present invention to provide a boiler build with identical serpentine tubes on each side so heat transfer and liquid flow are equalized throughout the boiler.

The boiler can be constructed wider and shorter in length because the tubes extend only to the centre to make it less expensive to manufacture.

In one form of the boiler, the gases in the gas passages above the furnace, or lowermost chamber, flow from the rear to the front of the boiler and exit at the rear. The boiler can accept a high tech burner with which the radiant products of combustion pass through the furnace, or lowermost chamber twice, and the gases in the gas passages above the furnace, or lowermost chamber, flow from the front to the rear of the boiler and exit at the front. This is accomplished by interchanging the differently bent serpentine tubes which form the access openings and allow the gases to flow from one gas passage to the gas passage above. In both configurations, the simple addition of an insulating board along the top of the uppermost tubes where the tubes connect to the upper manifold will redirect the gases to either the front or the rear of the boiler to exit to the atmosphere through the gas outlet.

For improved heat exchange, baffles may be installed within the gas passages to elongate the gaseous flow path. The baffles extend from top to bottom of the passage and from one of the sides toward, but terminating short of, the other side, whereby the combustion gases transversing that chamber from front to back or back to front are additionally forced to flow laterally to get around the baffles.

To provide for expansion and contraction of the metal of the serpentine tubes, the boiler may be brought from a cold condition to full operating temperature in about ten minutes. The boiler can operate with a temperature differential of 150 degrees Fahrenheit between the inlet and outlet. Also, the boiler can be cooled rapidly for examination and or repairs without sustaining any permanent structural damage.

The boiler can be easily field assembled without welding in existing buildings through existing doorways, thus eliminating costly general contract work.

The boiler meets all of the requirements of the American Society of Mechanical Engineers boiler and pressure vessels, sections I and IV, which are recognized by agencies of most governments. The novel boiler incorporates the best features of the fire boiler by controlling the passage of hot gases and, by confining the water within small tubes, takes advantage of the best features of the water tube boiler.

All internal parts and surfaces are easily accessible for service and cleaning so the unit is suitable for burning light oil, residual oils, crude oils, waste oils, and type of gas, and any type of coal or solid fuel, including municipal waste.

Other objects and further scope of applicability of the present invention will become apparent from the detailed description given hereinafter. It should be understood, however,, that this detailed description, while indicating preferred embodiments of the invention, is given by way of illustration only, since various changes and modifications within the spirit and scope of the invention will become apparent to those skilled in the art.

BRIEF DESCRIPTION OF THE DRAWINGS

The invention will be further described with reference to the accompanying drawings, wherein.

DESCRIPTION OF PREFERRED EMBODIMENTS

Figure 1:
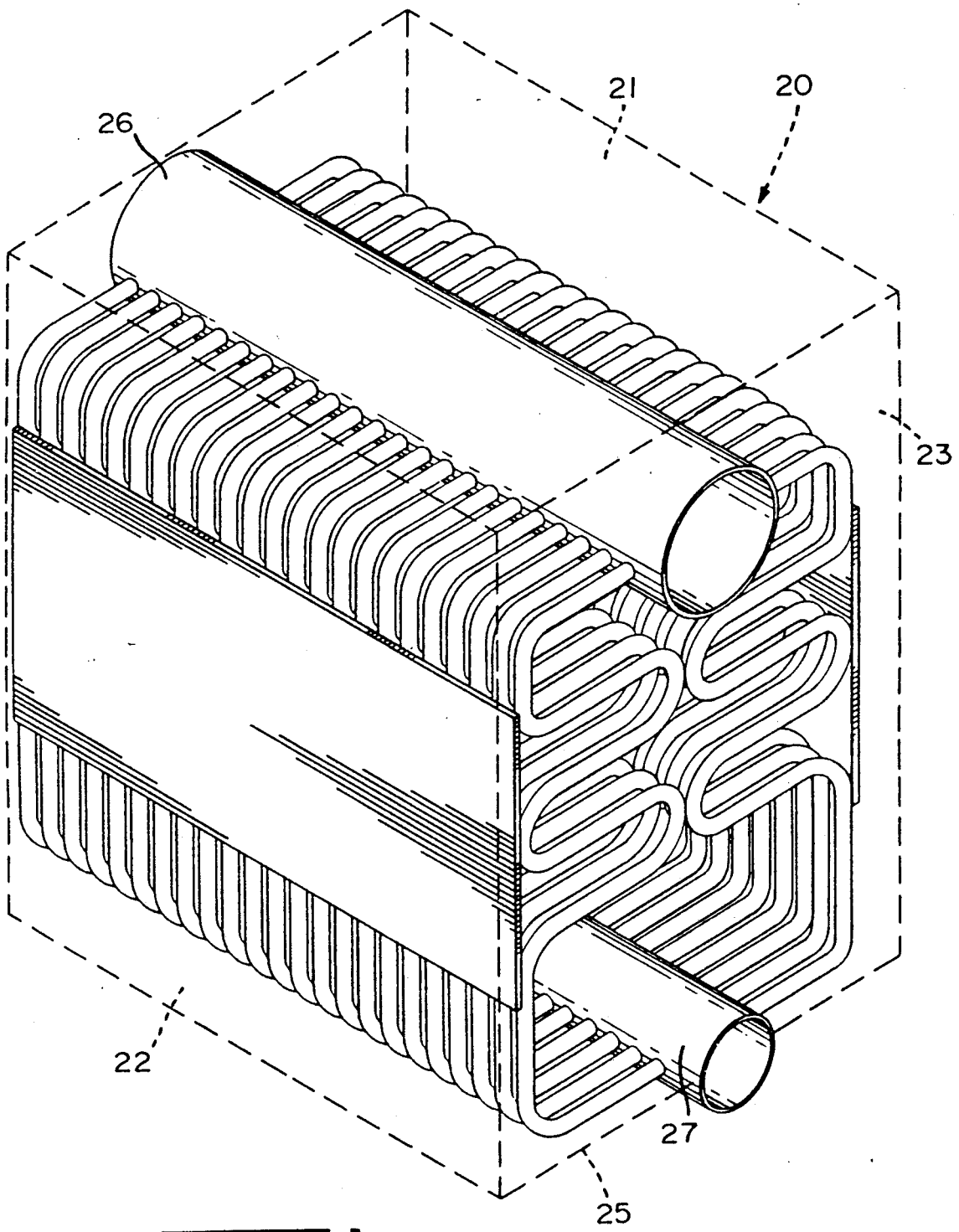
FIG. 1 is a perspective view of a boiler of the invention with the housing shown in phantom, the differently bent tubes that form the access openings not being shown for clarity.
Figure 2:
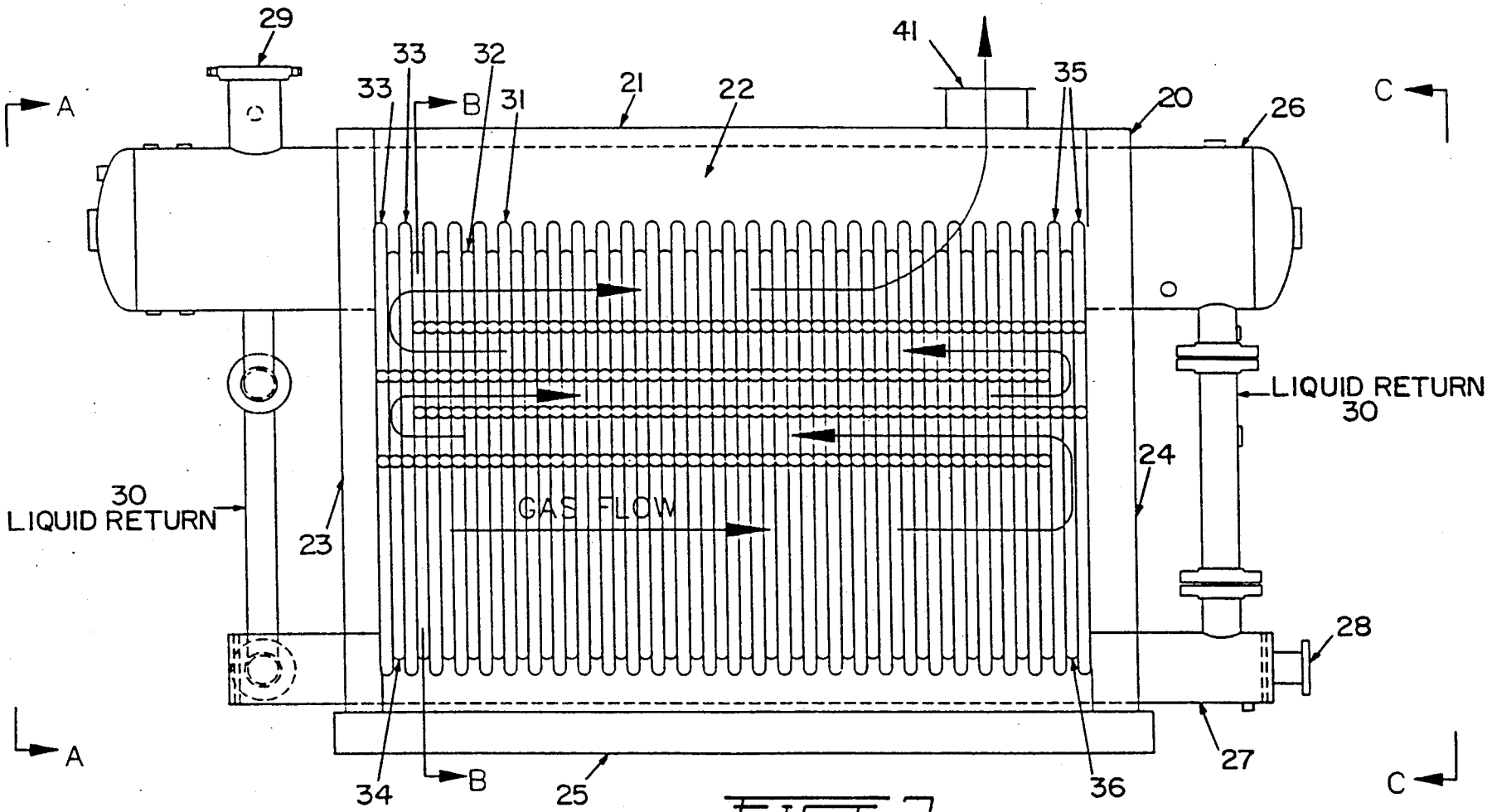
FIG. 2 is a side view of the boiler and housing with a single gas pass through the furnace, or lowermost passage, and the gas exit at the rear of the boiler.

Referring more particularly to FIGS. 1 and 2, there is shown a housing 20 having a top wall 21, opposite side walls 22, a front wall 23, a rear wall 24, a base 25, and a gas outlet 41 at the rear. There are also provided an upper manifold 26, a lower manifold 27, a connection 28 for introducing liquid into the lower manifold, a connection 29 for withdrawing heated liquid or steam from the upper manifold, liquid returns 30 connecting the bottom of the upper manifold to the top of the lower manifold: serpentine tubes 31 and 32 which form the gas passages, serpentine tubes 33 and 34 which form the access openings from gas passage to gas passage at the front, and serpentine tubes 35 and 36 which form the access openings from gas passage at the rear where gas outlet 41 is shown.

Figure 3:
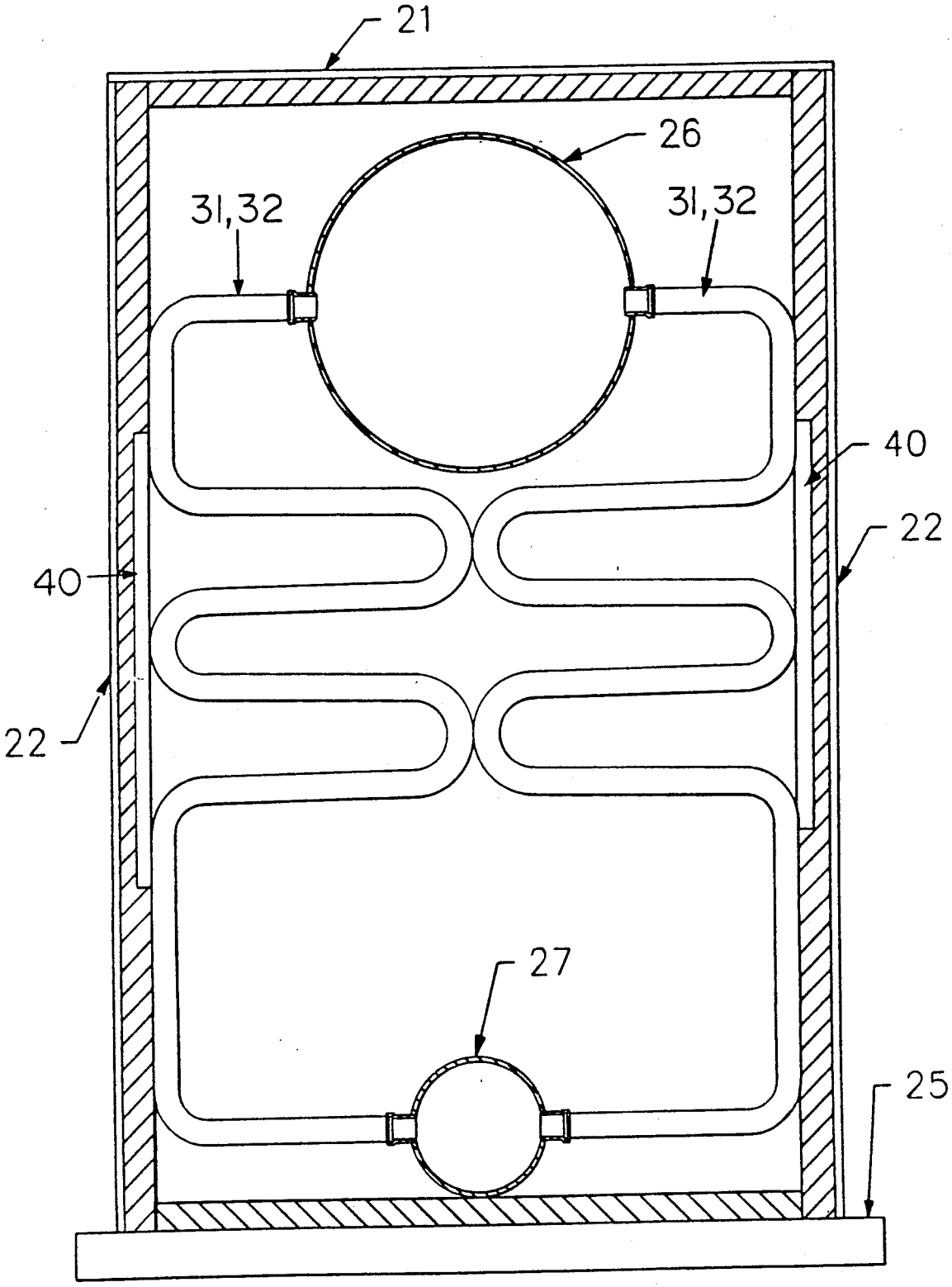
FIG. 3 is a cross-section at B—B of FIG. 2 and FIG. 10 showing the serpentine tubes and manifolds.
Figure 10:
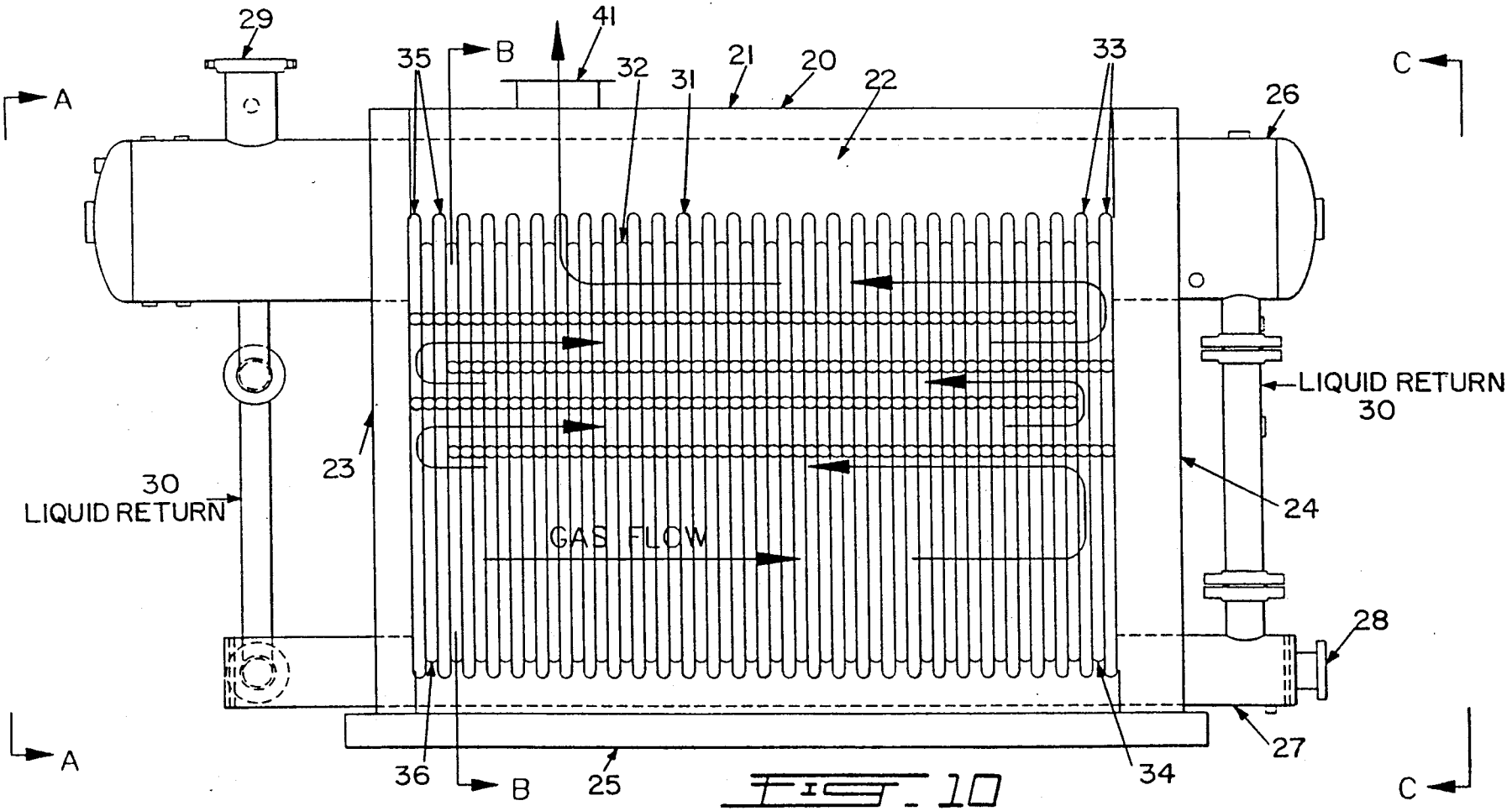
FIG. 10 is a side view of the boiler and housing with two gas passes in the furnace, or lowermost passage, and the gas exit at the front of the boiler.

FIG. 3 is a section common to the boilers of FIGS. 2 and 10 and shows the formation of gas passages with serpentine tubes 31 and 32 and a gas passage closing plate 40. It also shows the upper manifold 26 and the lower manifold 27 and it illustrates the tube connections to the manifolds.

Figure 4:
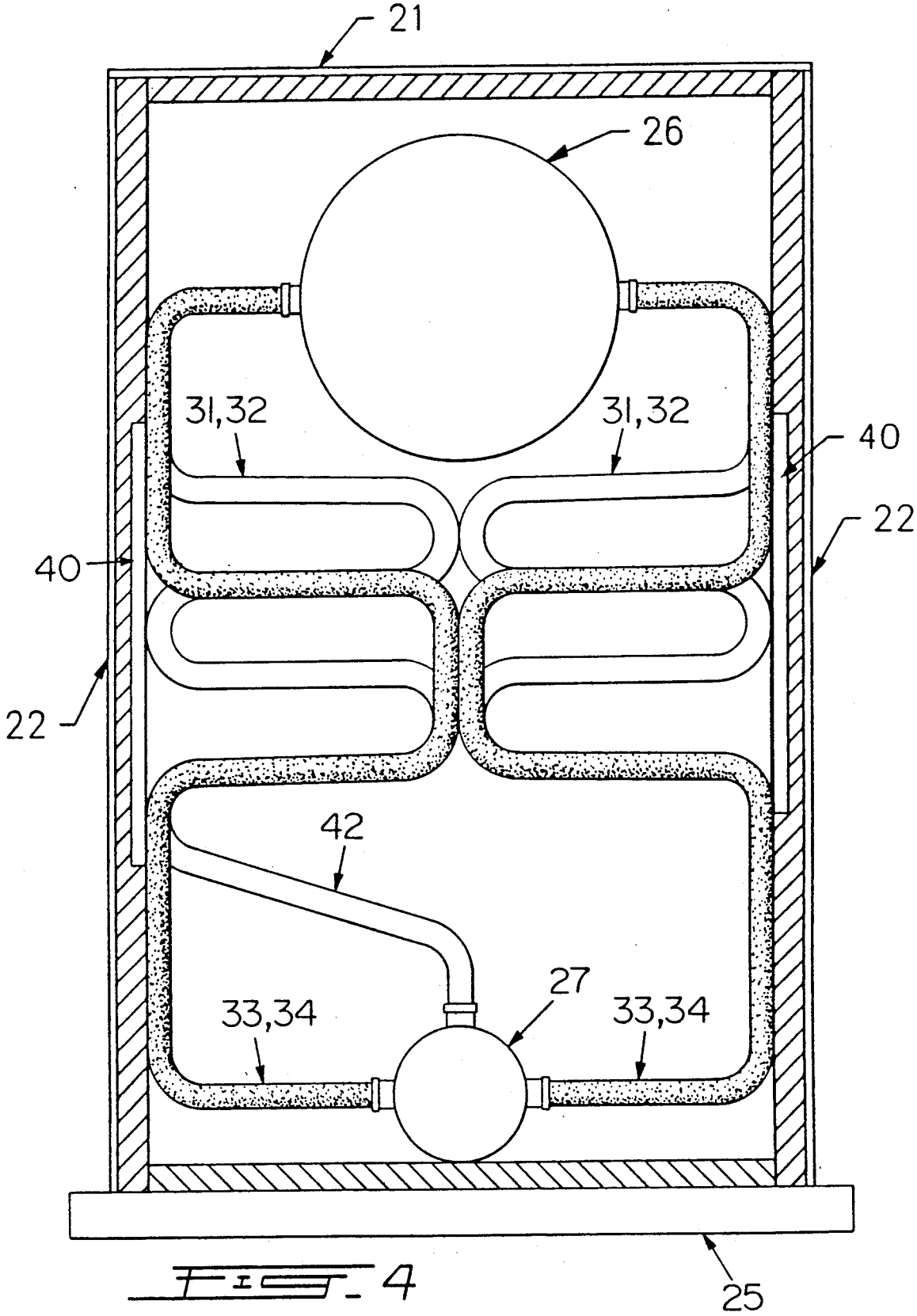
FIG. 4 is a front view of FIG. 2 showing the differently bent tubes that form the access opening to permit the gases to flow from one gas passage to the next.

FIG. 4 shows the serpentine tubes 33 and 34 that are bent differently to form the access openings that allow the gases to flow from one gas passage to the next. A vent tube 42 is shown.

Figure 5:
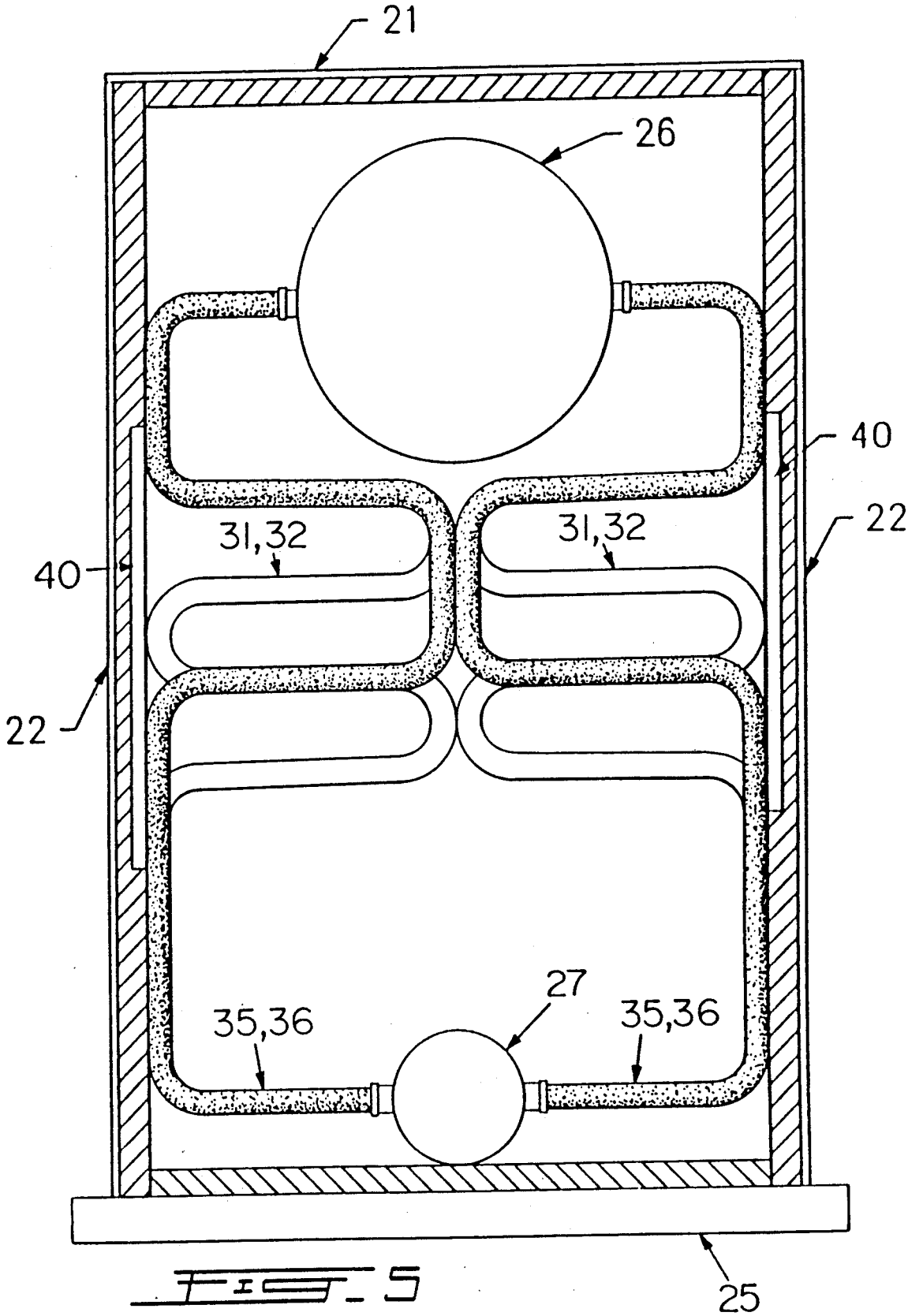
FIG. 5 is a rear view of FIG. 2 showing the differently bent tubes that form the access opening to permit the gases to glow from one gas passage to the next.

FIG. 5 is a rear view of FIG. 2 showing the serpentine tubes 35 and 36 that are bent differently to form the access openings that allow the gases to flow from one gas passage to the next.

Figure 6:
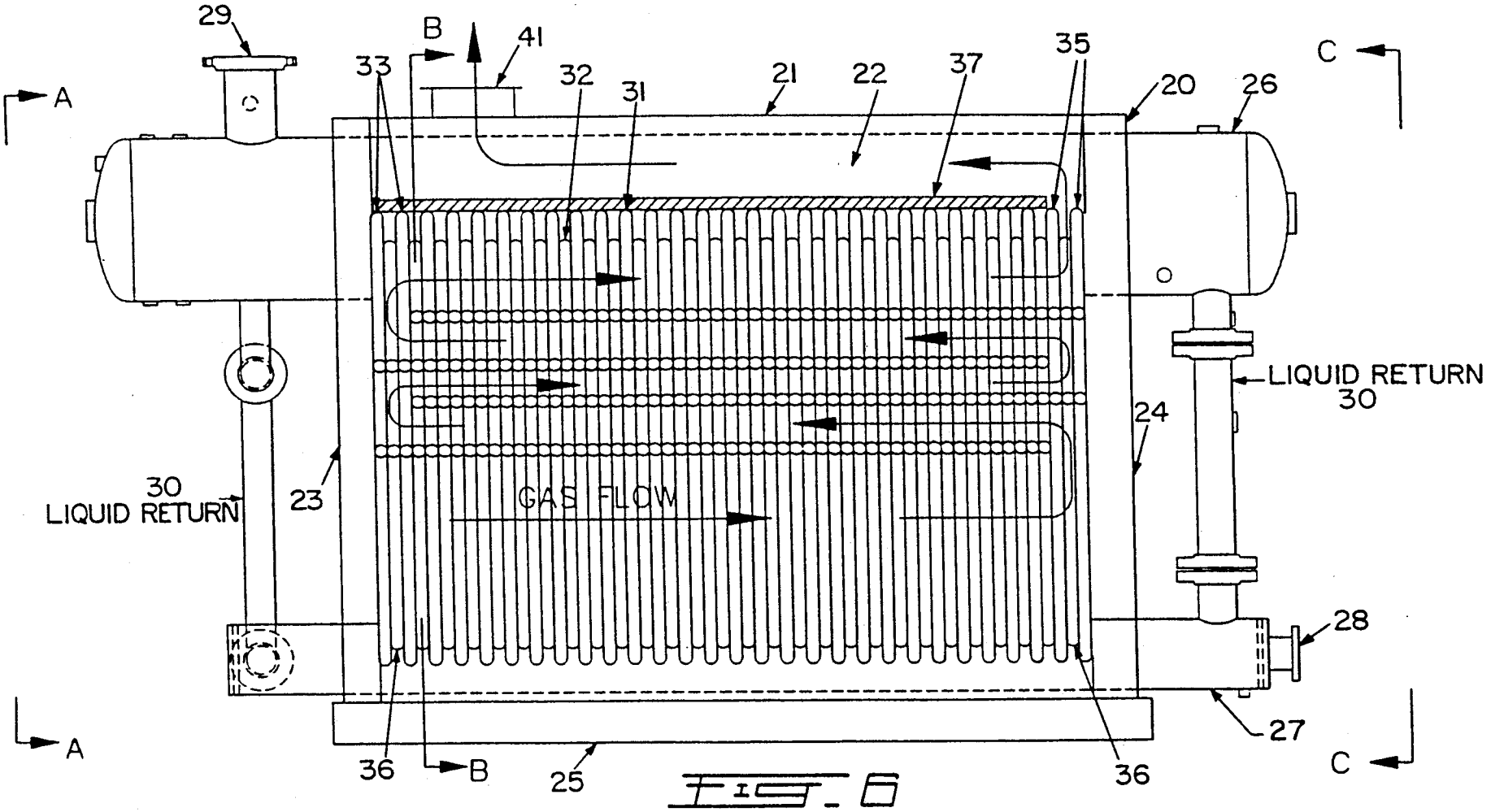
FIG. 6 is a side view of the boiler and housing with a single gas pass through the furnace, or lowermost passage, with an insulating board redirecting the gas to exit at the front of the boiler.

FIG. 6 shows the housing 20 with its serpentine arrangement; however, an insulating board 37 redirects the gases to the front of the boiler where the gas outlet 41 is now located.

Figure 7:
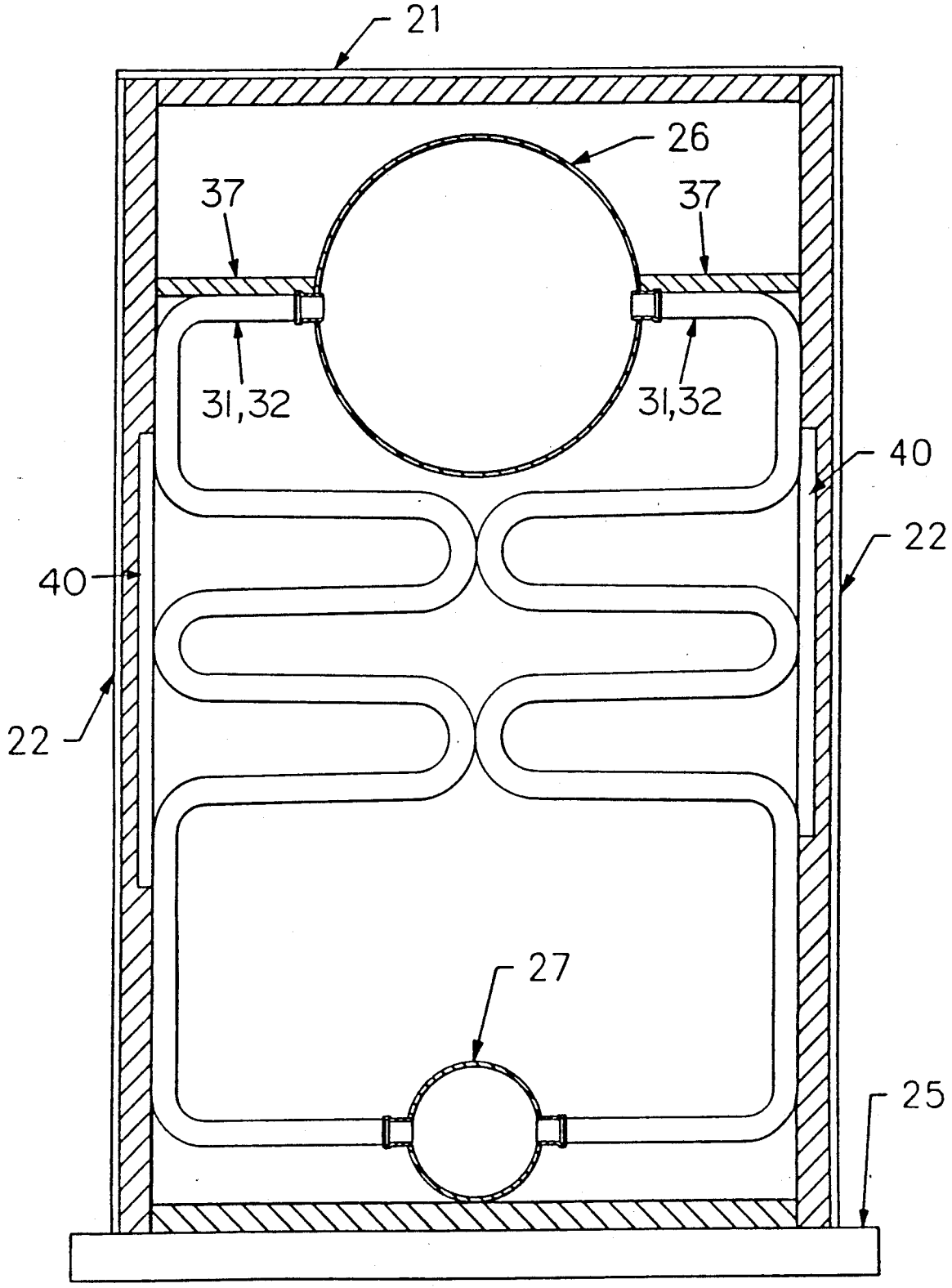
FIG. 7 is a cross-section at B—B of FIG. 6 and FIG. 13 showing the serpentine tubes, the manifolds and insulating board which redirects the gases.
Figure 13:
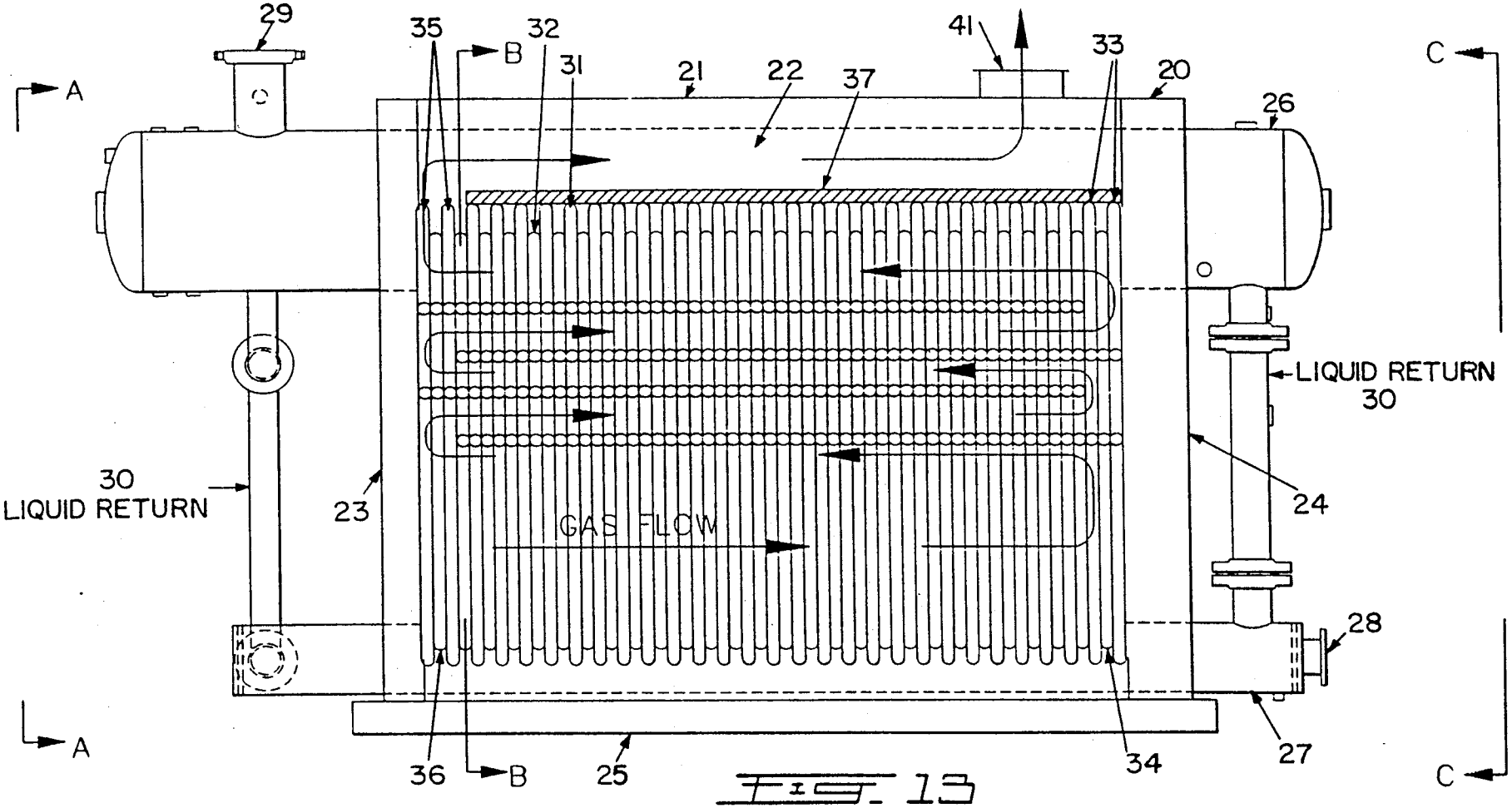
FIG. 13 is a side view of the boiler and housing with two gas passes in the furnace, or lowermost passage, with the insulating board redirecting the gas to exit at the rear of the boiler.

FIG. 7 is a section common to the boilers of FIG. 6 and 13 and shows the formation of gas passages with serpentine tubes 31 and 32 and the gas passage closing plate 40. It shows the insulating board 37 that redirects the gases.

Figure 8:
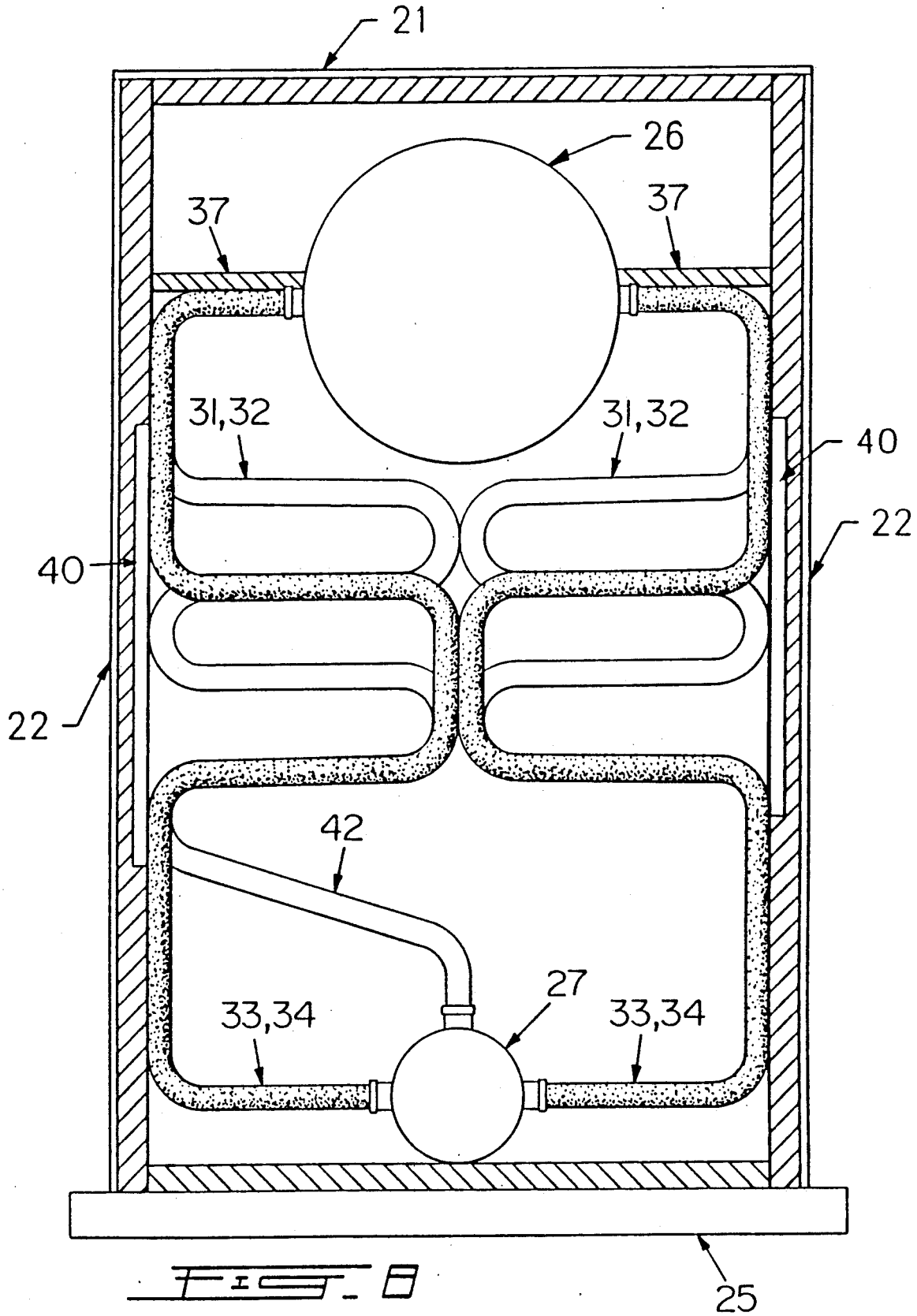
FIG. 8 is a front view of FIG. 6 showing the differently bent tubes that form the access opening to permit the gases to flow from one gas passage to the next with the insulating board which redirects the gases.

FIG. 8 is a front view and shows the serpentine tubes 33 and 34 that are bent differently to form the access openings that allow the gases to flow from one gas passage to the next and the insulating board 37 that redirects the gases.

Figure 9:
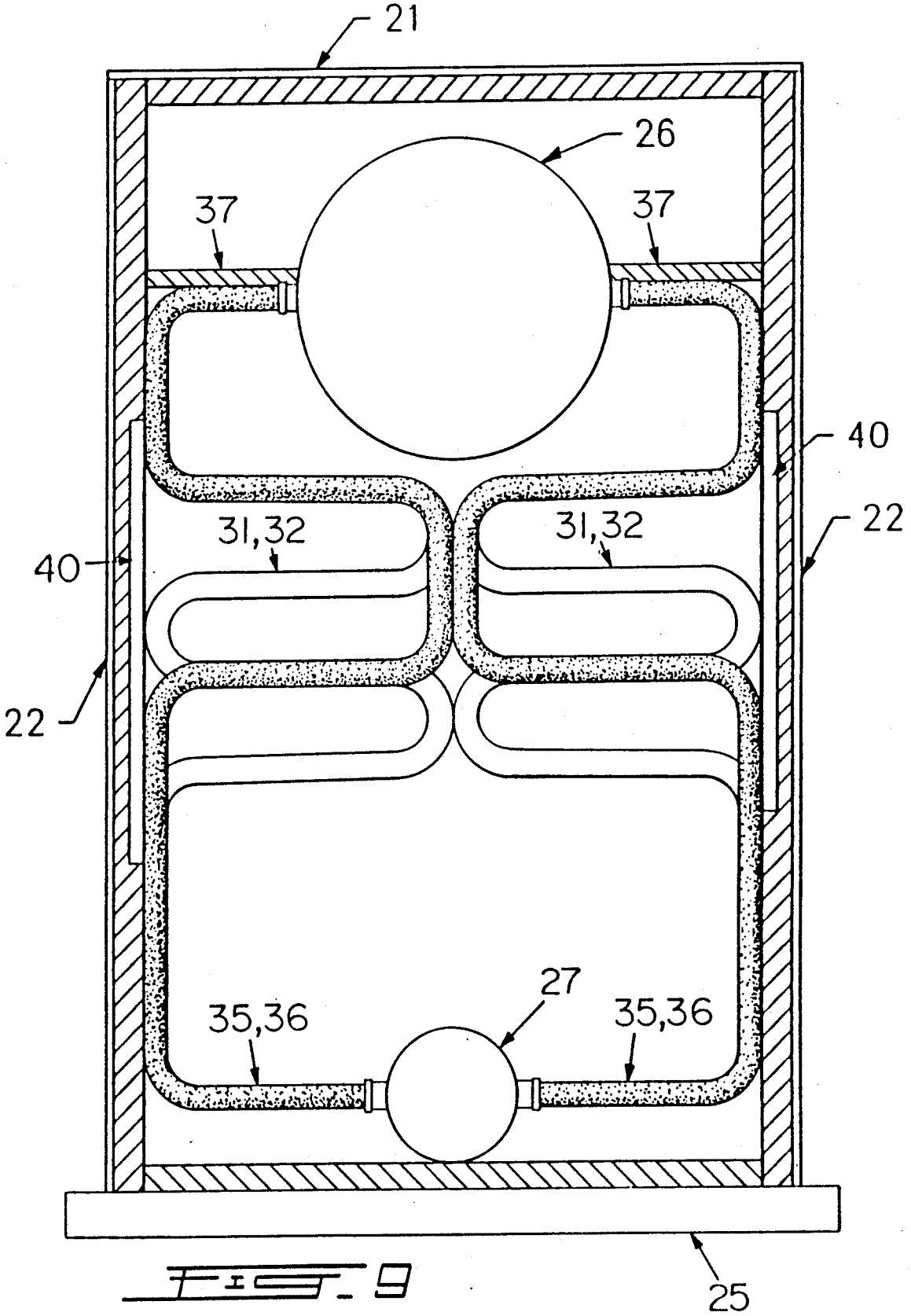
FIG. 9 is a rear view of FIG. 6 showing the differently bent tubes that form the access opening to permit the gases to flow from one gas passage to the next with the insulating board which redirects the gases.

FIG. 9 is a rear view and shows the serpentine tubes 35, 36 that are bent differently to form the access openings that allow the gases to flow from one gas passage to the next as well as the removable gas passage closing plate 40 and the insulating board 37 that redirects the gases.

FIG. 10 shows the housing with the gas outlet 41 at the front. Serpentine tubes 31 and 32 form the gas passages while serpentine tubes 33 and 34 form the access openings from gas passage to gas passage at the rear; serpentine tubes 35 and 36 form the access openings from gas passage to gas passage at the front.

Figure 11:
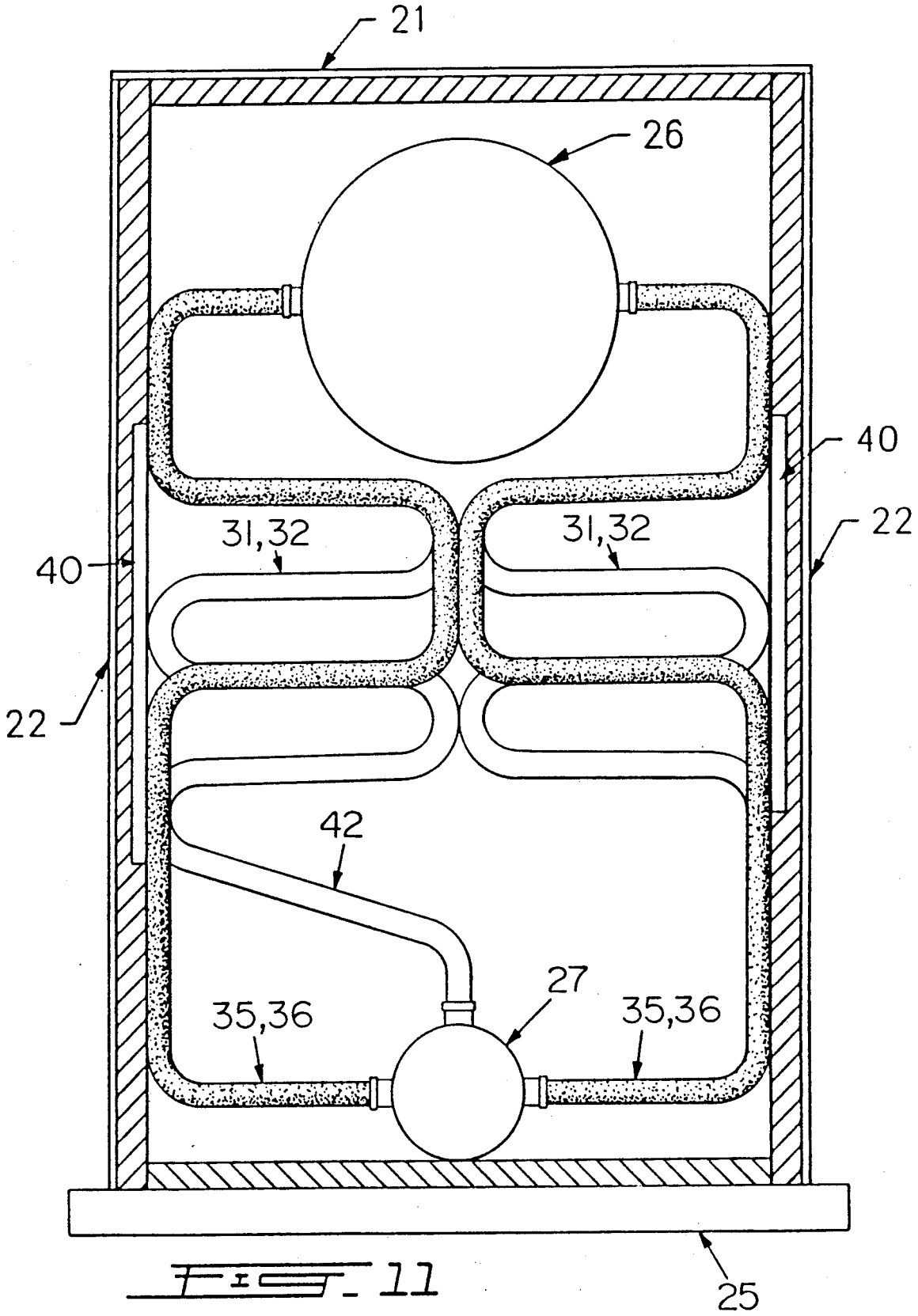
FIG. 11 is a front view of FIG. 10 showing the differently bent tubes that form the access opening to permit the gases to flow from one gas passage to the next.

FIG. 11 is a front view of FIG. 10 showing the serpentine tubes 35 and 36 that are bent differently to form the access openings that allow the gases to flow from one gas passage to the next.

Figure 12:
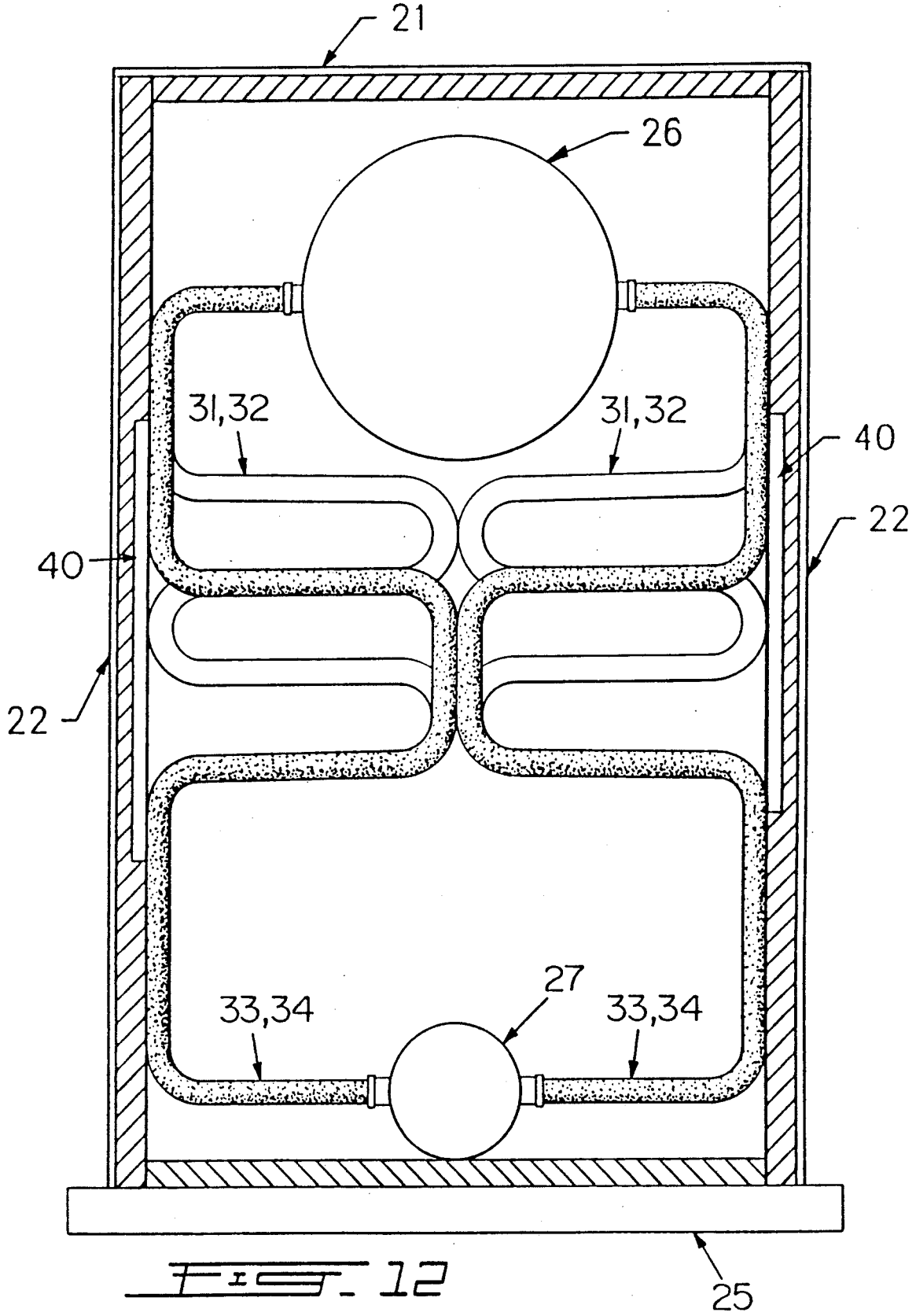
FIG. 12 is a rear view of FIG. 10 showing the differently bent tubes that form the access opening to permit the gases to flow from one gas passage to the next.

FIG. 12 is a rear view of FIG. 10 showing the serpentine tubes 33 and 34 that are bent differently to form the access openings that allow the gases to flow from one gas passage to the next.

FIG. 13 shows the housing with serpentine tubes 31 and 32 which form the gas passages, serpentine tubes 33 and 34 which form the access openings from gas passage to gas passage at the rear, serpentine tubes 35 and 36 which form the access openings from gas passage to gas passage at the front and the insulating board 37 that redirects the gases to the rear of the boiler.

Figure 14:
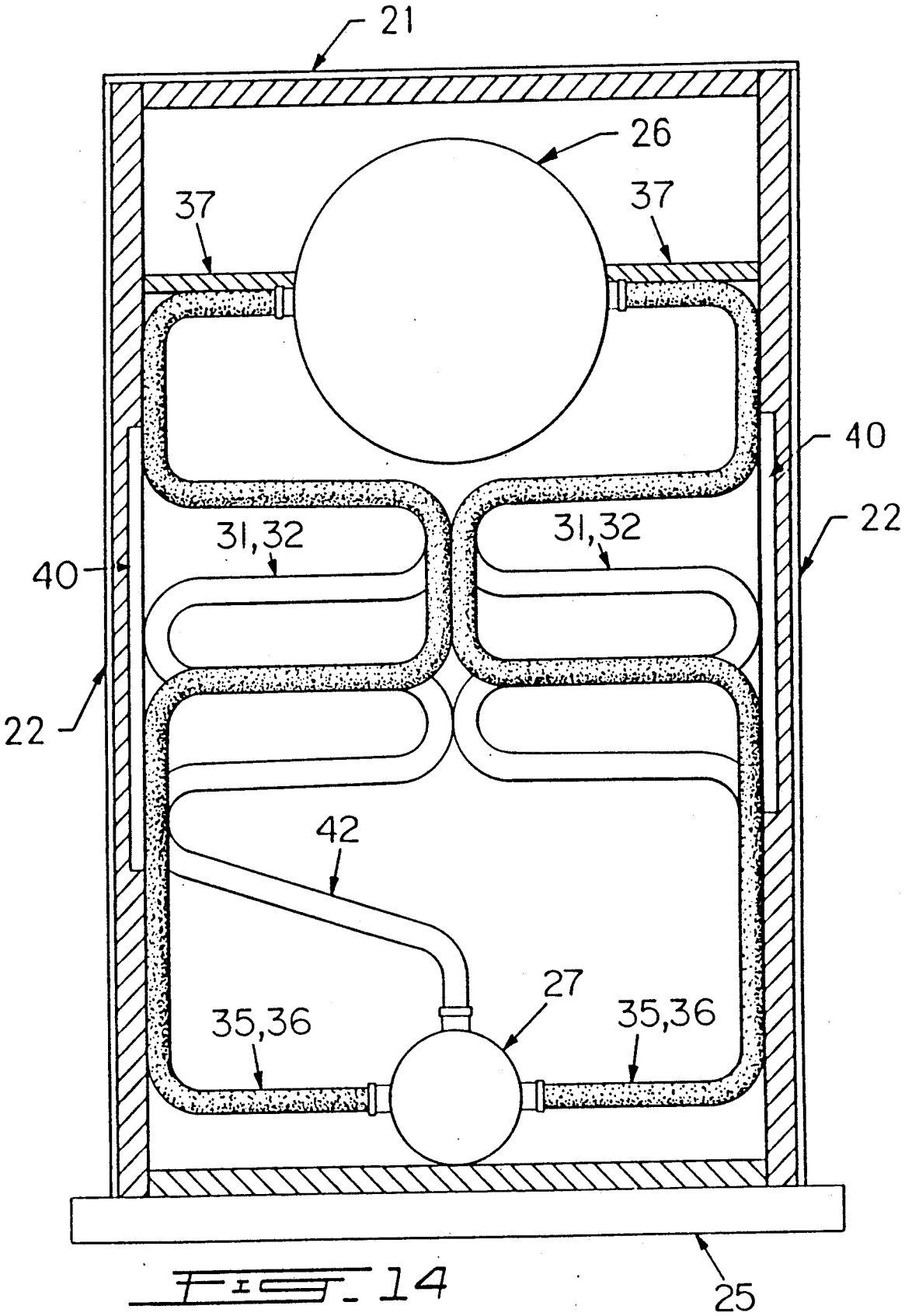
FIG. 14 is a front view of FIG. 13 showing the differently bent tubes that form the access opening to permit the gases to flow from one gas passage to the next with the insulating board which redirects the gases.

FIG. 14 is a front view of FIG. 13 showing serpentine tubes 35 and 36 which are bent differently to form the access openings that allow the gases to flow from one gas passage to the next. It also shows the insulating board 37 that redirects the gases.

Figure 15:
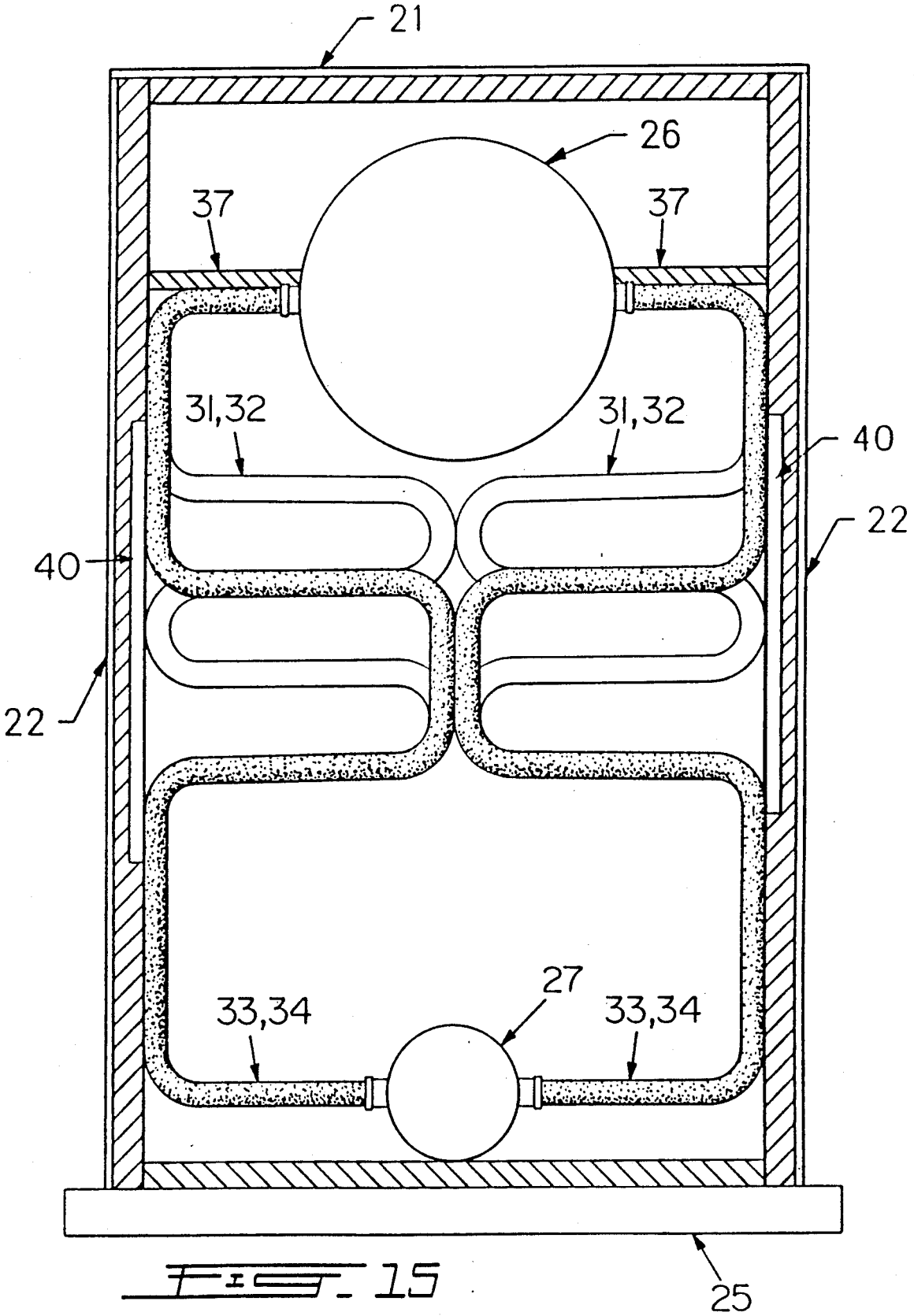
FIG. 15 is a rear view of FIG. 13 showing the differently bent tubes that form the access opening to permit the gases to flow from one gas passage to the next with the insulating board which redirects the gases.

FIG. 15 is a rear view of FIG. 13 showing serpentine tubes 33 and 34 which are bent differently to form the access openings that allow the gases to flow from one gas passage to the next and the insulating board 37 that redirects the gases.

Figure 16:
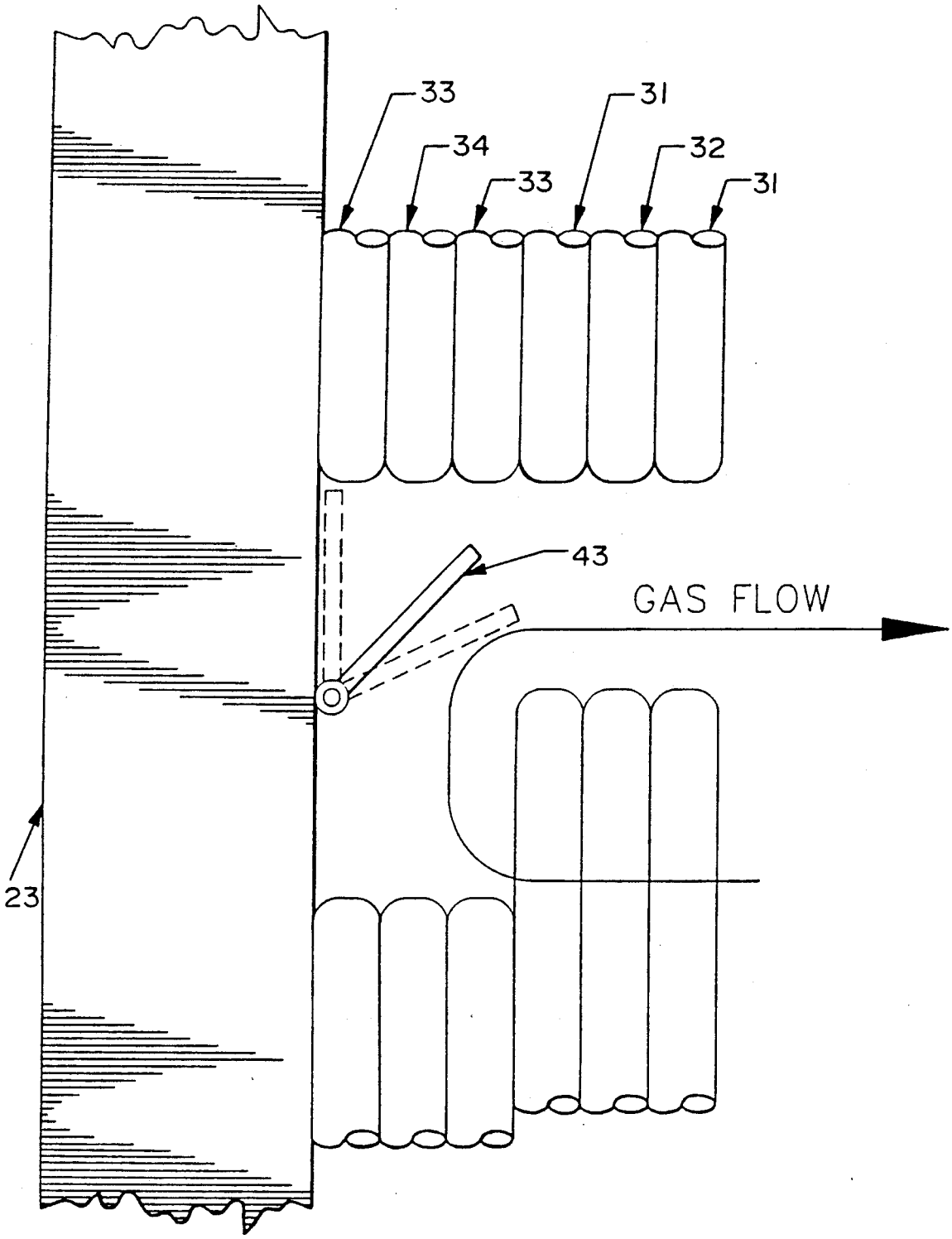
FIG. 16 is a detail of the furnace control damper.

FIG. 16 is a detail of the damper 43 at the access openings between the gas passages adjacent the front wall 23.

Figure 17:
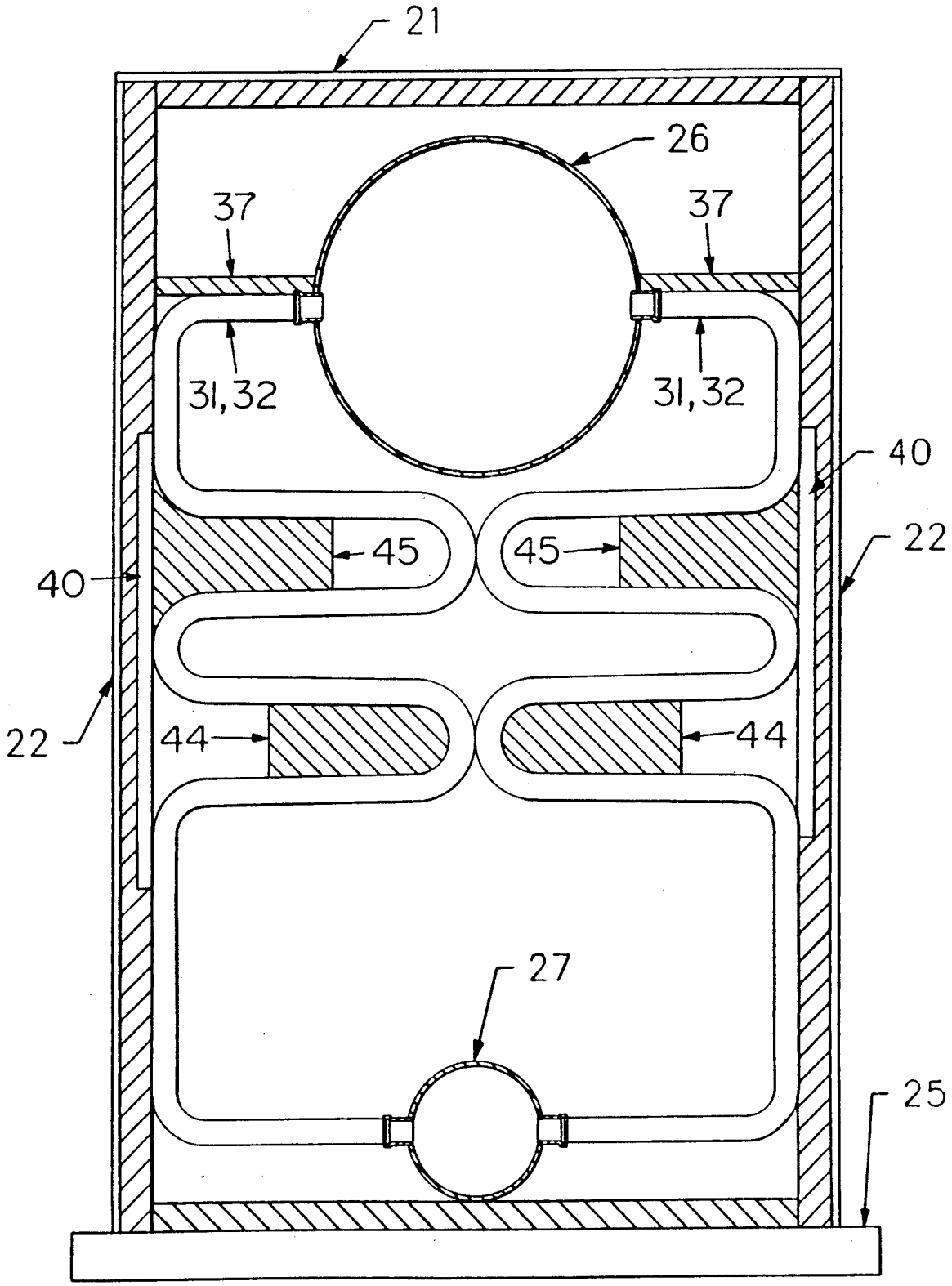
FIG. 17 is a section through the boiler showing optional baffles in the gas passages to elongate the gaseous flow path.

FIG. 17 is a section common to all boilers of the present invention showing optional baffles 44 and 45.

Figure 18:
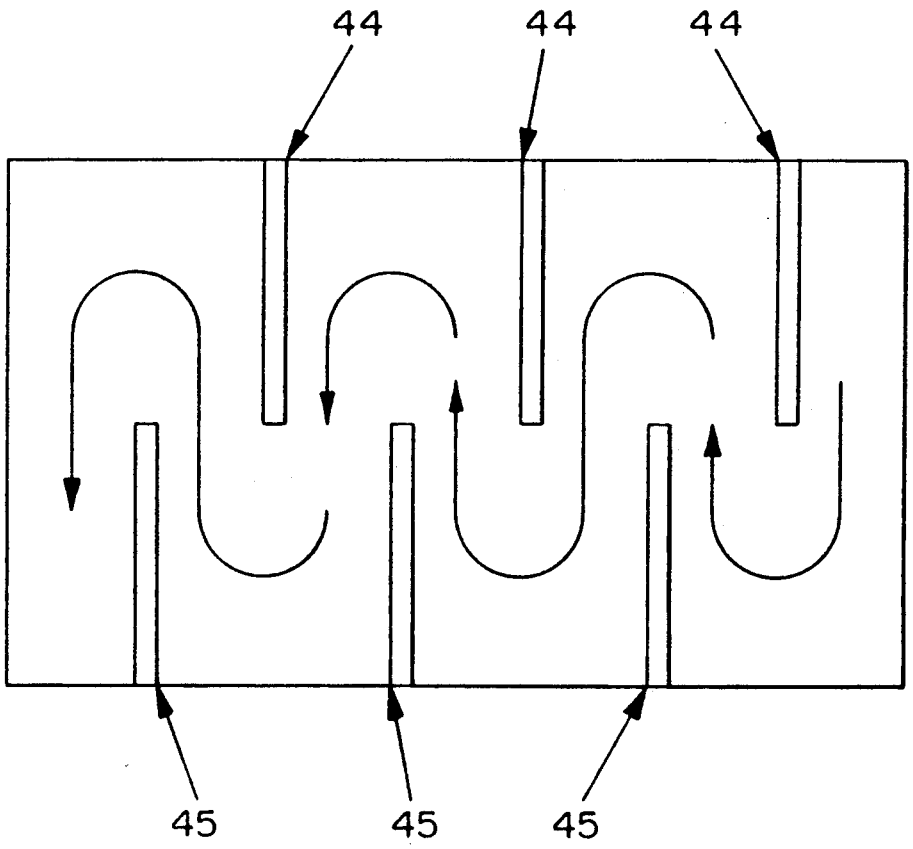
FIG. 18 is a top plan view of the gas flow across one of the gas passages showing the optional baffle.

FIG. 18 is a top plan view of the gas flow across one of the gas passages showing the optional baffles 44 and 45.

Figure 19:
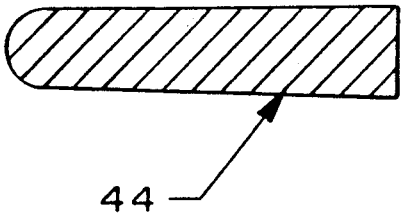
FIG. 19 is a detail of the optional baffle.

FIG. 19 is a detail of optional baffle 45.

Figure 20:
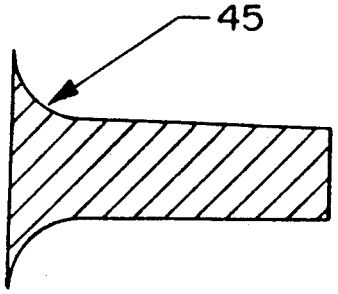
FIG. 20 is a detail of the optional baffle.

FIG. 20 is a detail of optional baffle 46.

The novel boiler offers advantages with regard to nitrogen oxides (NOX) discharges as well. The NOX generation can be held to a minimum if combustion is under steady load and ideal conditions are established. However, When the load fluctuates, there is a serious problem. In accordance with the present invention, the radiation section, i.e. the burner, is controlled independently of the convection section, i.e. the heat exchanger. Specifically, if less steam is required, so less fuel is burned; it is merely necessary to synchronize a motorized damper at the furnace to gas passage access opening with the burner firing rate control so that, as the firing rate reduces, the damper will close and, as the firing rate increases, the damper will open, thereby maintaining the furnace chamber at a constant pressure.

The tubes, drums and manifolds may be formed of conventional boiler materials such as iron, steel, etc., and the boiler surfaces may be lined with refractory material, as desired.

The boiler shown in the drawings has four chambers above the combustion chamber; but, by appropriate bending of the tubes, the number could be one to ten, or more.

The number of tubes can also be varied; but, one suitable installation has the following parameters:

(1) Upper manifold—20" dia X 162"
(2) Lower manifold—12" dia X 152"
(3) Tube diameters—1½" inches
(4) Number of tubes per side—61
(5) Total number of passages—5

Certain advantages of the system have already been noted but there are many more. Specifically, the novel construction has the following advantages:

(a) the ability to independently control the combustion chamber pressures at all firing rates makes the burning of any fuel more efficient and easier;

(b) the boiler can be efficiently fired with gas, oil or coal by fluidized bed, underfeed and spreader stroker, pulverized burner, wood or any solid combustible fuel or even municipal waste;

(c) the boiler gas passages are easily cleaned either manually or automatically;

(d) the boiler is suitable for exhaust gas utilization;

(e) the boiler meets the requirements of the ASME steam boiler construction code, Section 1, for low and high pressure steam, low and high temperature hot water, hot mineral oils and black liquor. The entrance of tubes into the manifolds allows large ligaments between the tube holes. This results in the boiler drums being as little as only 30 per cent of the thickness that is required in traditional boilers. This also allows the tubes to be attached to the drums by a drive morse taper rather than expanding the tube ends into the manifolds, which reduces labour costs in production and/or field assembly;

(f) the boiler does not require external draft controls of any kind;

(g) the boiler pressure vessel forms a perfect rectangular cube with water cooled sides and thus eliminates the need for expensive refractories and insulation; and (h) the boiler tubes provide free expansion and contraction in all areas.

It will be appreciated that the instant disclosure and examples are set forth by way of illustration only and that various modifications an changes may be made without departing from the spirit and scope of the present invention.

The embodiments of the invention in which an exclusive property or privilege is claimed are defined as follows:

1. A boiler comprising: a housing having a top provided with a gas outlet, a bottom, opposite side walls and front and rear walls; said housing containing an upper manifold and a lower manifold substantially parallel to the top, bottom and side walls; first and second sets of tubes each comprising a plurality of tubes, one set joining the upper manifold to the lower manifold on one side, and the other set joining the upper manifold to the lower manifold on the other side, the tubes rising from the lower manifold upwardly along their side wall, crossing the housing to the center where they are substantially in contact one to the other, recrossing the housing to their respective side wall, rising therealong and eventually joining the upper manifold so as to form a plurality of superposed passages; individual tubes being differently bent so as to form access openings from each passage to the passages above and below; the openings from passage to passage being offset so as to require a gas flowing through said passages to traverse one passage from front to back and the next passage from back to front; means for introducing liquid into one of the manifolds for withdrawing the liquid from the other manifold and means for introducing hot gases into the lowermost of the superposed passages; the hot gases rising successively through the passages which they successively and alternately traverse from front to back, then from back to front, until they exist from the uppermost passage through the gas outlet at the top; liquid flowing through the manifolds and tubes being heated by the hot gases.

2. A boiler according to claim 1, wherein the tubes of each set are in substantial contact with one another so as to substantially prevent passage of hot gases therebetween.

3. A boiler according to claim 1, including a plate at each side of the housing to laterally close off the superposed passages.

4. A boiler according to claim 1, where the tubes on each side are identical.

5. A boiler according to claim 4, where heat transfer and liquid flow are balanced across each tube on each side of the boiler.

6. A boiler according to claim 1, including an insulating board atop the tubes with an opening at one end remote from the gas outlet so that the gas leaving the uppermost passage defined by the tubes traverse the housing to arrive at the gas outlet.

7. A boiler according to claim 6, wherein the gas outlet and the means for introducing hot gases into the lowermost of the superposed passages are at opposite ends of the housing.

8. A boiler according to claim 7, wherein the gas outlet and the means for introducing hot gases into the lowermost of the superposed passages are at the same end of the housing.

9. A boiler according to claim 6, wherein there is an odd number of superposed passages.

10. A boiler according to claim 7, wherein there is an even number of superposed passages.

* * * * *